US008497755B2

(12) United States Patent
Park

(10) Patent No.: US 8,497,755 B2
(45) Date of Patent: Jul. 30, 2013

(54) HYBRID TRANSFORMER WITH TRANSFORMATION AND IMPROVED HARMONICS FUNCTIONS, UNBALANCED CURRENT, AND A POWER SUPPLY SYSTEM THEREOF

(76) Inventor: Hoon-Yang Park, Bucheon-si (KR)

( * ) Notice: Subject to any disclaimer, the term of this patent is extended or adjusted under 35 U.S.C. 154(b) by 256 days.

(21) Appl. No.: 13/055,505

(22) PCT Filed: Jul. 23, 2009

(86) PCT No.: PCT/KR2009/004117

§ 371 (c)(1),
(2), (4) Date: Jan. 24, 2011

(87) PCT Pub. No.: WO2010/011098

PCT Pub. Date: Jan. 28, 2010

(65) Prior Publication Data

US 2011/0115590 A1 May 19, 2011

(30) Foreign Application Priority Data

Jul. 24, 2008 (WO) ..... PCT/KR2008/004337

(51) Int. Cl.

| | |
|---|---|
| ***H01F 30/12*** | (2006.01) |
| ***H01F 27/28*** | (2006.01) |
| ***H01F 27/29*** | (2006.01) |
| ***H01F 5/00*** | (2006.01) |
| ***H01F 27/24*** | (2006.01) |
| ***H01F 17/04*** | (2006.01) |

(52) U.S. Cl.
USPC ..... 336/12; 336/5; 336/170; 336/182; 336/192; 336/200; 336/212; 336/221

(58) Field of Classification Search
USPC ..... 336/5, 12, 170, 182, 192, 200, 212, 336/221
See application file for complete search history.

(56) References Cited

U.S. PATENT DOCUMENTS

| | | | | |
|---|---|---|---|---|
| 5,416,458 | A * | 5/1995 | Menke et al. | 336/12 |
| 5,982,262 | A * | 11/1999 | Levin | 336/5 |
| 7,170,268 | B2 * | 1/2007 | Kim | 323/272 |
| 7,859,376 | B2 * | 12/2010 | Johnson, Jr. | 336/5 |
| 7,969,265 | B2 * | 6/2011 | Johnson, Jr. | 336/5 |
| 2007/0290670 | A1 * | 12/2007 | Lee | 323/361 |

* cited by examiner

*Primary Examiner* — Mohamad Musleh
*Assistant Examiner* — Tsz Chan
(74) *Attorney, Agent, or Firm* — John K. Park; Park Law Firm

(57) ABSTRACT

The present invention provides a hybrid transformer. In a transformer comprising a primary core and a secondary coil, the hybrid transformer includes a core with a 1st leg, a 2nd leg, and a 3rd leg; and a secondary coil with a 1st winding, a 2nd winding and a 3rd winding, which are wound zigzag on said 1st leg, said 2nd leg, and said 3rd leg. Two types of windings selected from the group consisting of said 1st winding, said 2nd winding and said 3rd winding are wound alternatively on said 1st leg, said 2nd leg, and said 3rd leg, respectively. However, the two types of windings wound on said 1st leg, said 2nd leg, and said 3rd leg, respectively, are wound in an overlapping manner around said core in the winding order.

18 Claims, 10 Drawing Sheets

HYBRID TRANSFORMER WITH TRANSFORMATION AND IMPROVED HARMONICS FUNCTIONS, UNBALANCED CURRENT, AND A POWER SUPPLY SYSTEM THEREOF

TECHNICAL FIELD

The present invention relate to a hybrid transformer having a transformation function and an improved function of harmonics and current unbalance, and a power supply system including the same

BACKGROUND ART

In general, electrical transformers are devices that are connected in series to a transmission and distribution system to transform alternating voltage or current from one level to another using a electromagnetic induction phenomenon.

In the meantime, harmonics and unbalanced current are generated in an electric power system due to an increase in a non-linear load along with the development of power semiconductors. Such harmonics and unbalanced current are inputted to a power supply of low impedance, which leads to several problems including overheating of cables, an increase in power loss due to magnetic saturation of transformer cores, erroneous operation of electric devices, etc.

A K-factor transformer of increased capacity, a harmonics reduction device serving as an aid for the transformer, a current unbalance compensation device, a reactor, and the like are separately installed to reduce damage caused by harmonics and current unbalance. However, this solution to the above-mentioned problem is extremely low in price efficiency and economic efficiency due to problems such as increase in investment costs involved in dual facility investment and installation space security.

Therefore, there is a need for the development of a hybrid transformer having a transformation function and an improved function of harmonics and current unbalance in order to solve the above-mentioned problems and secure price efficiency and economical efficiency.

DISCLOSURE OF INVENTION

Technical Problem

Accordingly, the present invention has been made in order to satisfy the above-mentioned necessities, and it is an object of the present invention to provide a hybrid transformer including a harmonics reduction function and a current unbalance cancellation function.

Another object of the present invention is to provide a power supply system including the hybrid transformer.

The objects of the present invention are not limited to the above objects, and other objects which are not disclosed will be appreciated from the following detailed description by those skilled in the art.

Technical Solution

To achieve the above objects, in one aspect, the present invention provides a hybrid transformer including a primary coil, a secondary coil and a core, wherein the core includes a first leg, a second leg and a third leg, and the secondary coil includes a first winding, a second winding and a third winding, which are wound in a zig-zag fashion around the first leg, the second leg and the third leg, respectively, so as to be connected to a neutral wire, and wherein two types of windings selected from the group consisting of the first winding, the second winding and the third winding of the secondary coil are wound alternately around the first leg, the second leg and the third leg, respectively, in such a fashion as to be wound in an overlapping manner around the core in the winding order.

In another aspect, the present invention provides a hybrid transformer including a core including a first leg, a second leg and a third leg, and a first winding, a second winding and a third winding, which are wound in a zig-zag fashion around the first leg, the second leg and the third leg, wherein a plurality of windings selected from the group consisting of the first winding, the second winding and the third winding are wound around the first leg, the second leg and the third leg, respectively, in such a fashion as to be wound in an overlapping manner around the core in the winding order.

In yet another aspect, the present invention provides a hybrid transformer including a primary coil, a secondary coil and a core, wherein the core includes a first leg, a second leg and a third leg, and the secondary coil includes a first winding, a second winding and a third winding, and wherein the first winding is wound around the first leg and the third leg in the order of the first leg, the third leg, the first leg, the third leg and the first leg so as to be connected to a neutral wire, the second winding is wound around the second leg and the first leg in the order of the second leg, the first leg, the second leg, the first leg and the second leg so as to be connected to the neutral wire, and the third winding is wound around the third leg and the second leg in the order of the third leg, the second leg, the third leg, the second leg and the third leg so as to be connected to the neutral wire, whereby the first winding, the second winding, the first winding, the second winding and the first winding are sequentially wound in an overlapping manner around the first leg, the second winding, the third winding, the second winding, the third winding and the second winding are sequentially wound in an overlapping manner around the second leg, and the third winding, the first winding, the third winding, the first winding and the third winding are sequentially wound in an overlapping manner around the third leg.

The power supply system according to the embodiments of the present invention includes a transformation function as well as an improved function of harmonics and current unbalance, so that the necessity of a separate device for improving harmonics and current unbalance is eliminated.

In addition, since the hybrid transformer according to the embodiments of the present invention is implemented in a more efficient structure and method, it is considerably excellent in both a harmonics reduction function and a current unbalance cancellation function. More specifically, the hybrid transformer according to the embodiments of the present invention has a structure in which since a plurality windings is wound overlappingly around each of the first, second and third legs, the volume of the transformer can be greatly reduced. Further, the zig-zag winding method is easily performed, and thus, the time and cost in the manufacture process can be greatly saved, resulting in an increase in a manufacturing cost saving effect. Besides, since the windings are wound efficiently at less volume, the efficiency of the transformer increases. That is, since the transformer is implemented in a more efficient structure and method, it is possible to provide a hybrid transformer which is considerably excellent in both a harmonics reduction function and a current unbalance cancellation function while maintaining a transformer performance.

Concrete contents of other embodiments are included in the following detailed description and accompanying drawings.

EXPLANATION ON REFERENCE NUMERALS OF MAIN ELEMENTS OF THE DRAWINGS

Figure 1:
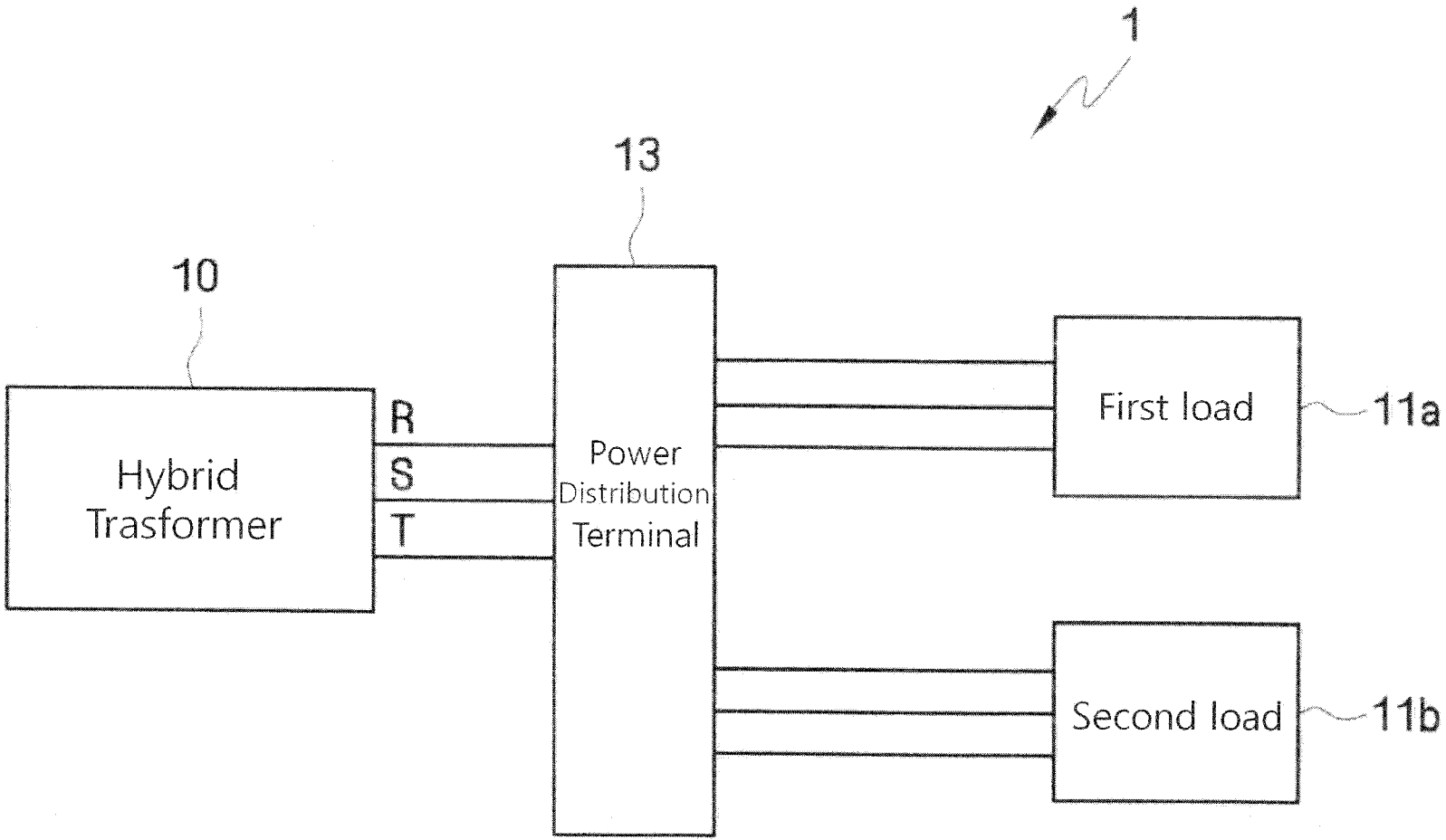
FIG. 1 is a schematic block diagram illustrating a power supply system according to one embodiment of the present invention.

1: power supply system
10, 20: hybrid transformer
110, 112: core
120, 122: primary coil
200, 202: secondary coil

BEST MODE FOR CARRYING OUT THE INVENTION

The features, advantages and methods of accomplishing the same of the present invention will be apparent from the following detailed description of the preferred embodiments of the invention in conjunction with the accompanying drawings. The present invention is not limited to the embodiments disclosed herein, but may be implemented in various different forms. These embodiments are provided to make the disclosure of the present invention complete and fully inform the scope of the present invention to a person of ordinary skill in the art to which the present invention pertains. The present invention should be defined by the technical scope of the appended claims. Throughout the specification, it is noted that the same reference numerals are used to designate the same constituent elements having the same function.

The terminology herein is merely used to describe specific embodiments of the present invention, but is not intended to limit the present invention. It should be noted that, in this specification and the appended claims, the singular forms, "a," "an," or "the", includes plural referents unless the context clearly dictates otherwise.

It should be appreciated that the terms "comprise(s)", "comprising", "include(s)", and "including", or "have (has)" when used in this specification and in the following claims are intended to specify the presence of stated features, integers, steps, acts, elements, components or combination thereof, but they do not preclude the presence or addition of one or more other features, integers, steps, acts, elements, components or combination thereof Now, preferred embodiments of the present invention will be described hereinafter in detail with reference to the accompanying drawings.

FIG. 1 is a schematic block diagram illustrating a power supply system according to one embodiment of the present invention.

Referring to FIG. 1, a power supply system 1 according to one embodiment of the present invention includes a hybrid transformer 10. The hybrid transformer 10 is connected in series to a power supply (not shown) outputting three-phase power supplied from a power plant along a power transmission line. In addition, the hybrid transformer 10 is electrically connected to a power distribution terminal 13 that distributes the supplied three-phase power to a first load 11*a* and a second load 11*b*, respectively. The concrete construction of the hybrid transformer 10 will described later.

Meantime, the hybrid transformer 10 of the power supply system 1 according to one embodiment of the present invention reduces harmonics and cancels voltage (or current) unbalance caused by a facility of a power distribution system or the first load 11*a* and the second load 11*b* by itself. That is, since harmonics can be reduced and voltage or current unbalance is cancelled by installation of the hybrid transformer 10, a harmonics reduction device and a voltage or current unbalance compensation device are not required separately. Thus, the power supply system 1 according to one embodiment of the present invention can save investment costs, and can reduce a power loss occurring in the power distribution system.

The hybrid transformer according to one embodiment of the present invention will be described in more detail with reference to the accompanying drawings.

Figure 2:
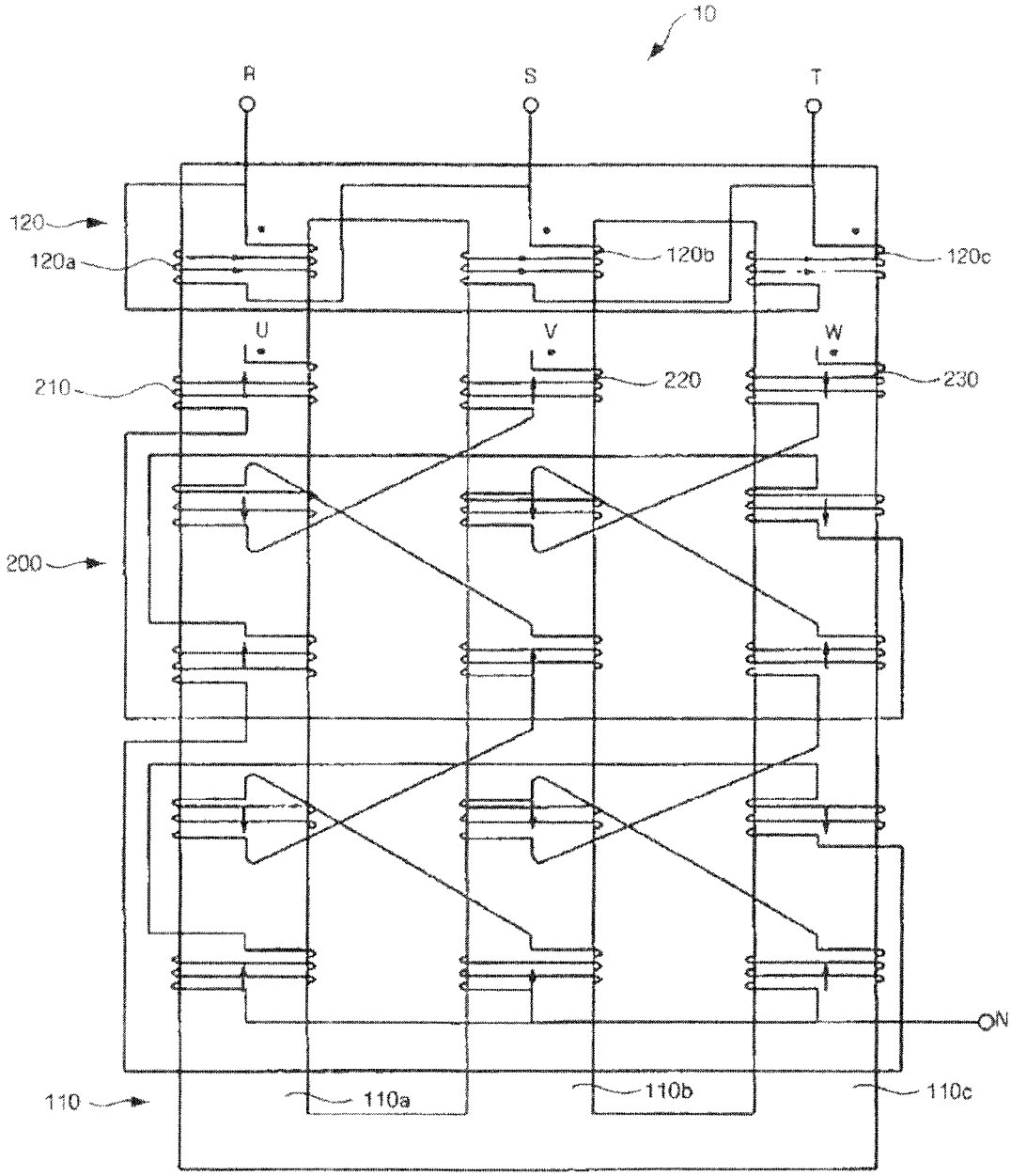
FIG. 2 is a conceptual view illustrating a hybrid transformer according to one embodiment of the present invention.
Figure 3:
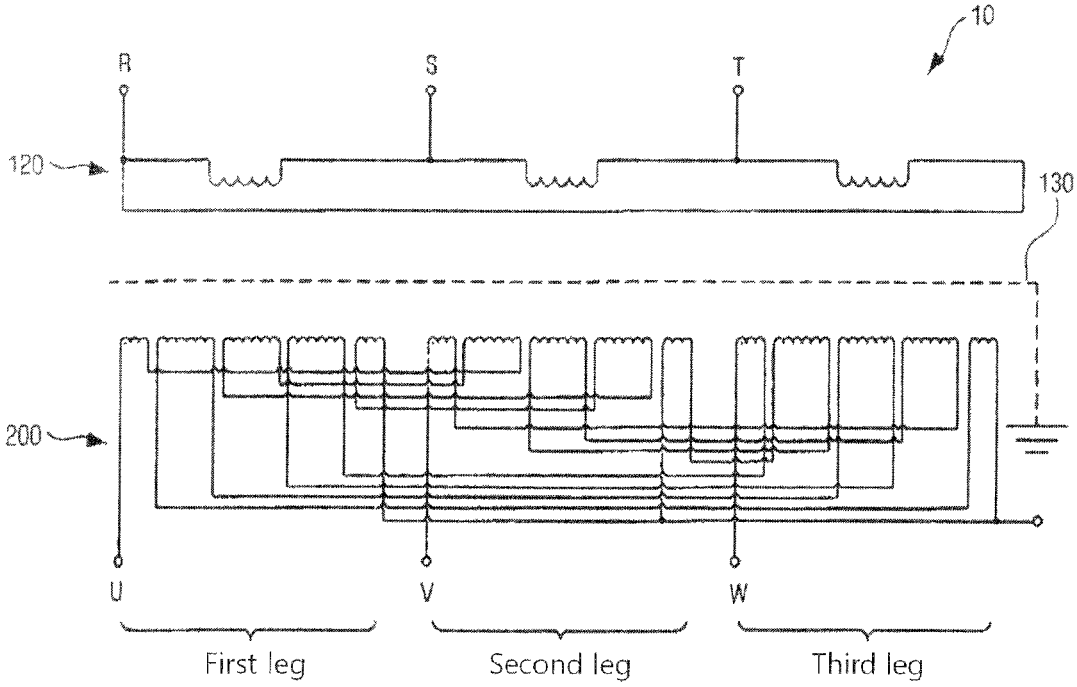
FIG. 3 is a view illustrating a part of a winding of a hybrid transformer according to one embodiment of the present invention.

FIG. 2 is a conceptual view illustrating a hybrid transformer according to one embodiment of the present invention, and FIG. 3 is a view illustrating a part of a winding of a hybrid transformer according to one embodiment of the present invention.

First, referring to FIGS. 2 and 3, the hybrid transformer 10 according to one embodiment of the present invention includes a core 110, a primary coil 120, and a secondary coil 200.

Herein, the hybrid transformer 10 according to one embodiment of the present invention may be a delta-wye (Δ-Y) transformer. That is, the primary coil 120 of the hybrid transformer 10 can be wound in a delta (Δ) type, and the secondary coil 200 can be wound in a Y type. But, it is of course noted that the coil winding type of the hybrid transformer 10 according to embodiments of the present invention is not limited thereto, and the coil winding of the hybrid transformer can be performed in a various methods by a person of ordinary skill in the art to which the present invention pertains. For the sake of convenience of explanation, an example of the delta-wye (Δ-Y) transformer will be described.

The core 110 includes a first leg 110*a*, a second leg 110*b*, and a third leg 110*c*. The first leg 110*a*, the second leg 110*b*, and the third leg 110*c* can be arranged juxtaposedly as shown in FIG. 2. The core 110 may use a silicon steel plate. Alternatively, the core 110 may use amorphous metal. Amorphous metal is an amorphous magnetic material produced by rapidly cooling a molten metal in which iron (Fe), boron (B), silicon (Si), etc., are mixed. But, it is of course noted that the amorphous metal is limited thereto.

The primary coil 120 can be wound in a delta (A) type. The primary coil 120 includes a first winding 120*a*, a second winding 120*b*, and a third winding 120*c*. The first winding 120*a*, the second winding 120*b*, and the third winding 120*c* can be wound in the same direction around the first leg 110*a*, the second leg 110*b*, and the third leg 110*c*, respectively. In this case, the first winding 120*a*, the second winding 120*b*, and the third winding 120*c* may be wound one or more turns around the first leg 110*a*, the second leg 110*b*, and the third leg 110*c*, respectively. For example, the turn ratio of the first winding 120*a*, the second winding 120*b*, and the third winding 120*c* may be 1:1:1, but is not limited thereto.

The secondary coil 200 can be wound in a Y type around the first leg 110*a*, the second leg 110*b*, and the third leg 110*c*. The secondary coil 200 includes a first winding 210, a second winding 220, and a third winding 230. The secondary coil 200 can be wound in a zig-zag fashion around the first leg 110*a*, the second leg 110*b*, and the third leg 110*c* to reduce harmonics and unbalance of voltage and current generated from the power distribution system. In other words, current flowing through the secondary coil 200 to be wound in the zig-zag fashion is controlled to flow in the direction of cancelling a magnetic flux generated from the core 110 by current flowing through the primary coil 120.

The zig-zag winding of the secondary coil 200 means that the first winding 210, the second winding 220 and the third winding 230 constituting the secondary coil 200 are wound in a crossing manner around two or more legs selected from the group consisting of the first leg 110*a*, the second leg 110*b* and the third leg 110*c* of the core 110. Alternatively, the zig-zag winding of the secondary coil 200 may mean that two or more windings selected from the group consisting of the first winding 210, the second winding 220 and the third winding 230 of the secondary coil 200 are wound in a crossing manner around the first leg 110*a*, the second leg 110*b* and the third leg 110*c* of the core 110, respectively.

For example, referring to FIGS. 2 and 3, the hybrid transformer 10 according to one embodiment of the present invention is constructed such that the first winding 210 of the secondary coil 200 is wound around the first leg 110*a* and the third 110*c* in the order of the first leg 110*a*, the third leg 110*c*, the first leg 110*a*, the third leg 110*c* and the first leg 110*a*, and the second winding 220 of the secondary coil 200 is wound around the second leg 110*b* and the first 110*a* in the order of the second leg 110*b*, the first leg 110*a*, the second leg 110*b*, the first leg 110*a* and the second leg 110*b*. Also, the third winding 230 of secondary coil 200 is wound around the third leg 110*c* and the second leg 110*b* in the order of the third leg 110*c*, the second leg 110*b*, the third leg 110*c*, the second leg 110*b* and the third leg 110*c*. In this case, the first winding 210, the second winding 220 and the third winding 230 are constructed to be connected to a neutral wire N, respectively.

In the meantime, the first winding 210 of the secondary coil 200 may be wound in an opposite direction to the winding order around the first leg 110*a* and the third leg 110*c*, and the second winding 220 may be wound in an opposite direction to the winding order around the second leg 110*b* and the first leg 110*a*. In addition, the third winding 230 may be wound in an opposite direction to the winding order around the third leg 110*c* and the first leg 110*a*. Then, the magnitudes of the magnetic fluxes on the respective legs 110*a*, 110*b* and 110*c* are the same, but the phases of zero-phase sequence current generated from loads are opposite to each other so that the magnetic flux is cancelled, and thus harmonics and current of an unbalanced component are reduced.

The turn ratios of the first winding 210, the second winding 220 and the third winding 230 of the secondary coil 200, which are wound in a zig-zag fashion around the first leg 110*a*, the second leg 110*b* and the third leg 110*c*, may be 1:1:1:1:1 or 1:2:2:2:1, respectively. That is, for example, the turn ratio of the first winding 210 wound in a zig-zag fashion around the first leg 110*a* and the third 110*c* in the order of the first leg 110*a*, the third leg 110*c*, the first leg 110*a*, the third leg 110*c* and the first leg 110*a* may be 1:1:1:1:1 or 1:2:2:2:1. But, the turn ratio of the first winding 210 is not limited thereto, and it is obvious that the first winding 210 can be wound in various turn ratios within a range which can be implemented by a person of ordinary skill in the art to which the present invention pertains.

In the meantime, in the case where the primary coil 120 and the secondary coil 200 are wound in a Δ type and in an Y type, respectively, a ground plate 130 may be interposed between the primary coil 120 and the secondary coil 200. In the case where relatively high voltage is applied to the primary coil 120, the ground plate 130 reduces electrical damage occurring in the first load 11*a* and the second load 11*b* connected to the secondary coil 200 to which relatively low voltage is applied. In addition, the ground plate 130 prevents introduction of harmonics generated between the power supply and the first load 11*a*/the second load 11*b*.

Now, the physical structure of the hybrid transformer according to one embodiment of the present invention will be described hereinafter in detail with reference to FIGS. 2 to 6.

Figure 4:
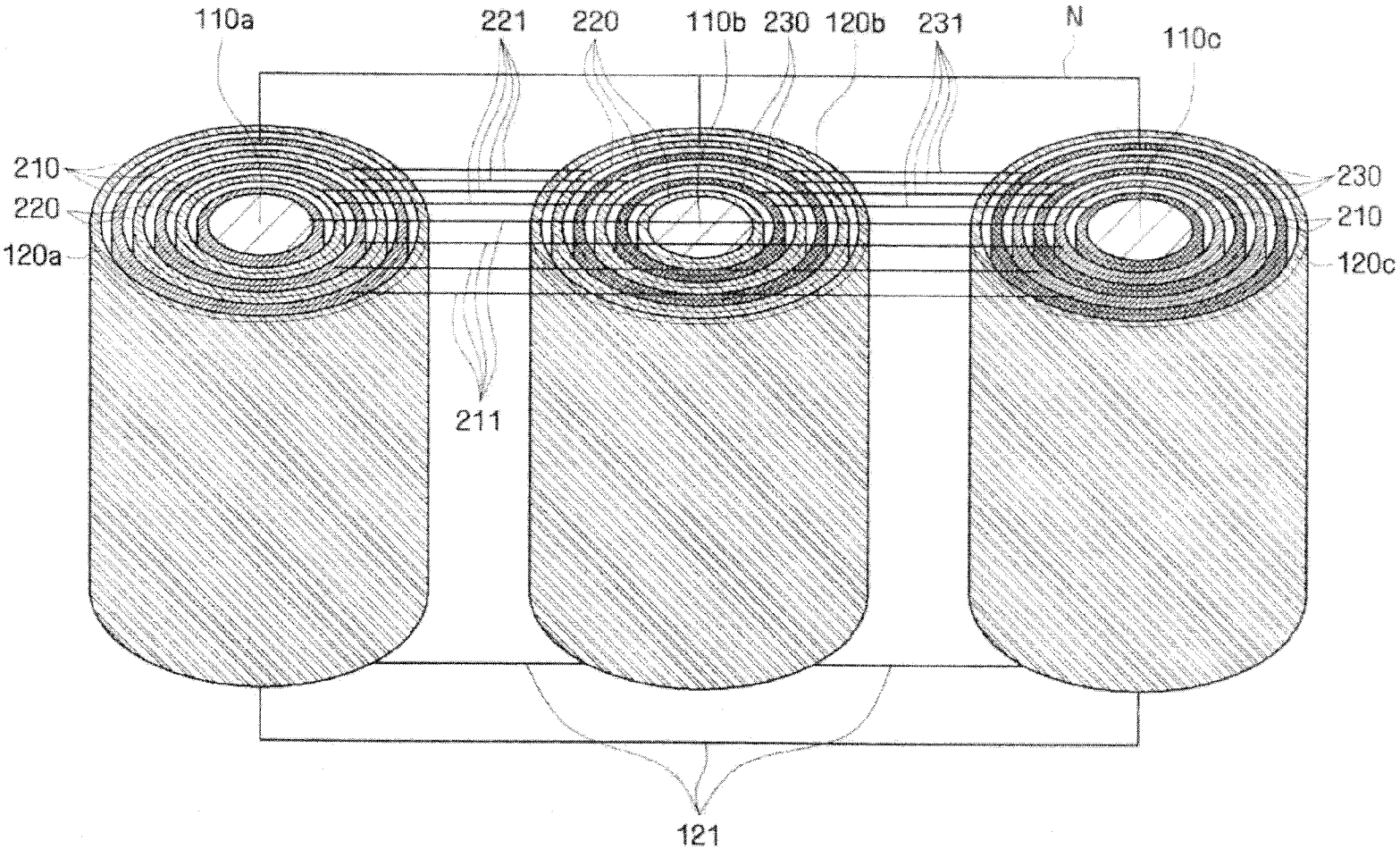
FIG. 4 is a perspective view illustrating a hybrid transformer according to one embodiment of the present invention.
Figure 5:
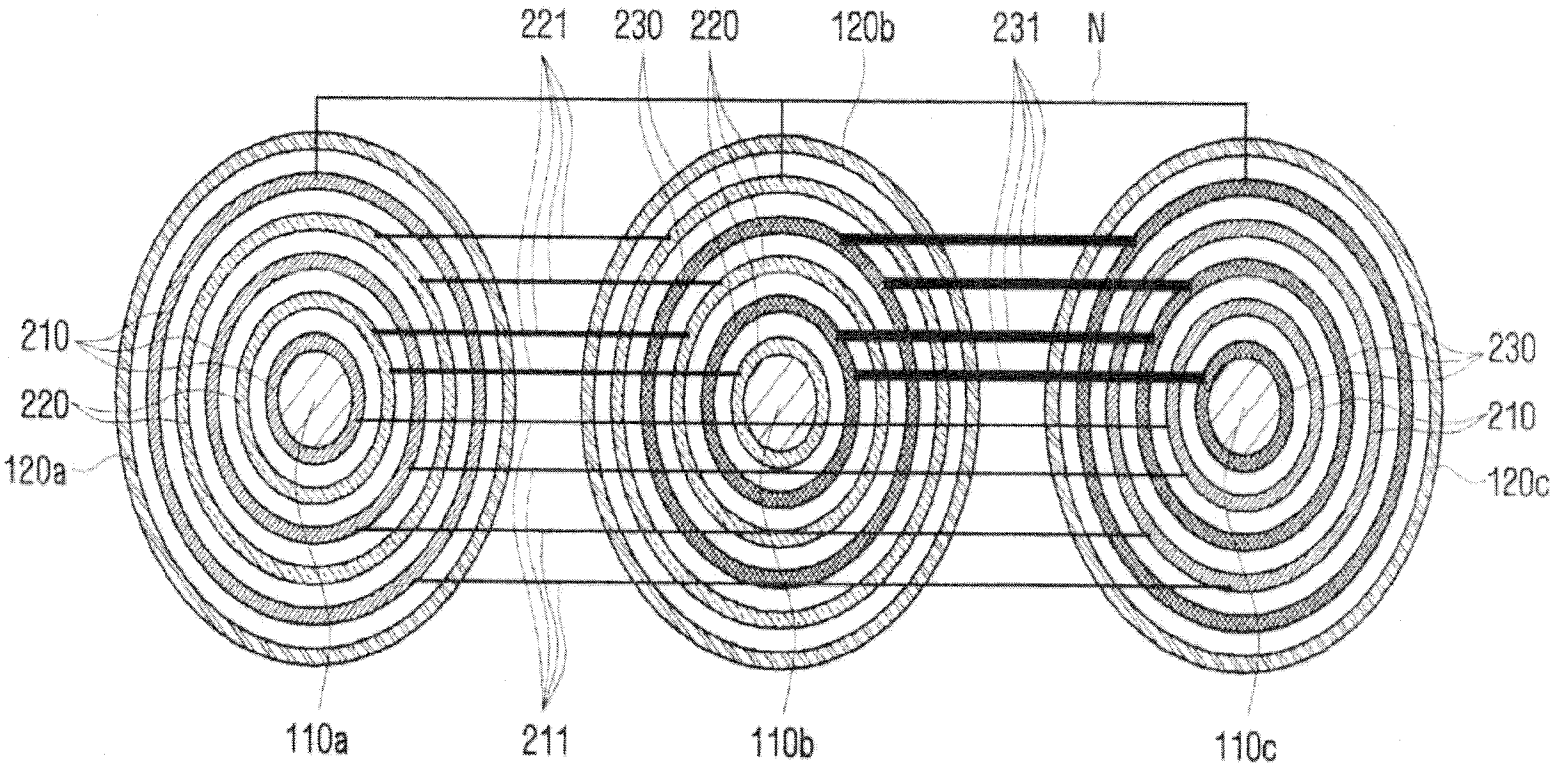
FIG. 5 is a top plan view of the hybrid transformer shown in FIG. 4.
Figure 6:
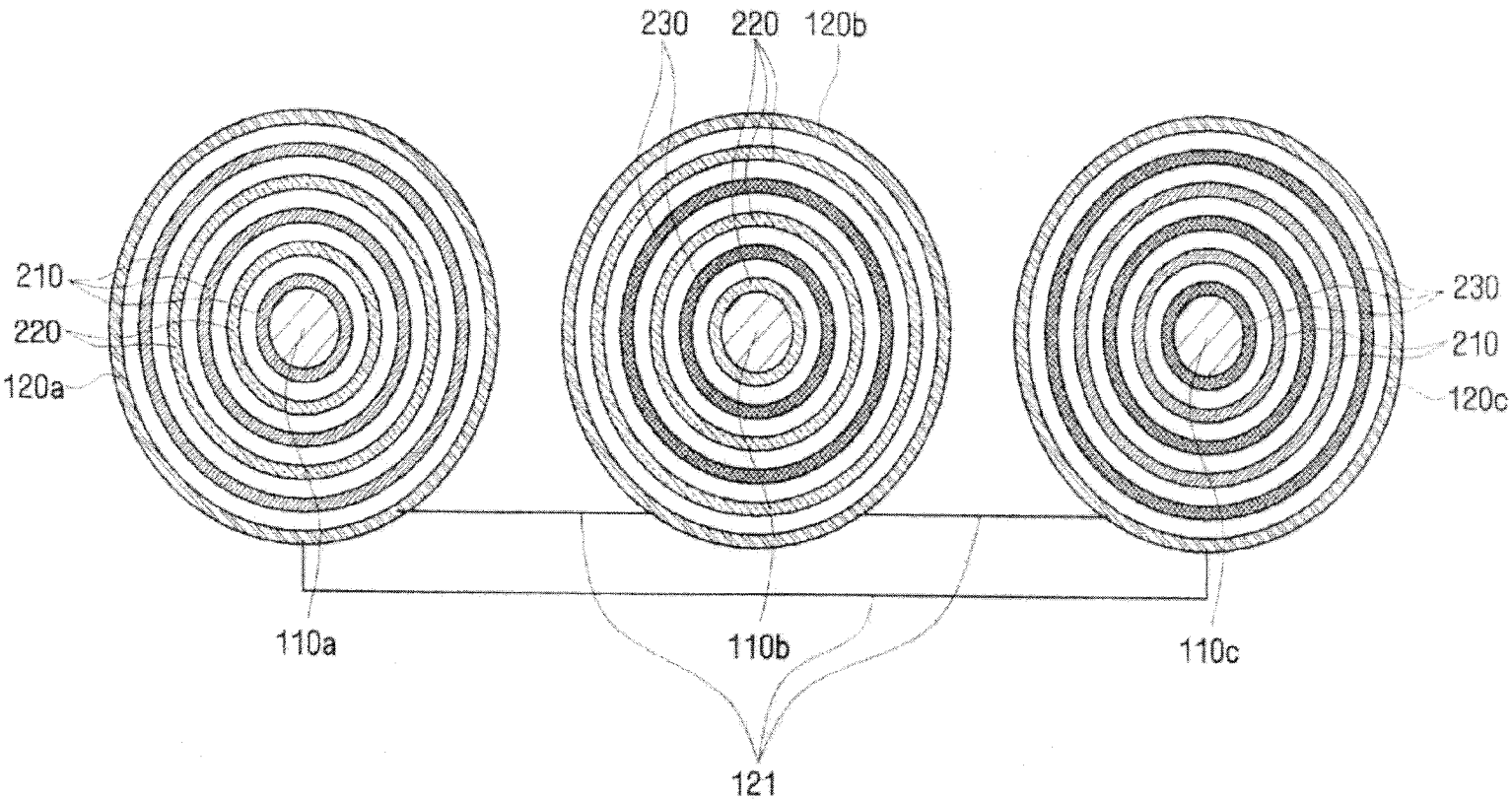
FIG. 6 is a bottom view of the hybrid transformer shown in FIG. 4.

FIG. 4 is a perspective view illustrating a hybrid transformer according to one embodiment of the present invention, FIG. 5 is a top plan view of the hybrid transformer shown in FIG. 4, and FIG. 6 is a bottom view of the hybrid transformer shown in FIG. 4.

Referring to FIGS. 2 to 6, the hybrid transformer 10 according to one embodiment of the present invention is constructed such that the first winding 210, the second winding 220 and the third winding 230 of the secondary coil 200 are wound in a zig-zag fashion around the first leg 110*a*, the second leg 110*b* and the third leg 110*c* of the core 110 as described above. In this case, two types of windings selected from the group consisting of the first winding 2100, the second winding 220 and the third winding 230 of the secondary coil 200 are wound alternately around the first leg 110*a*, the second leg 110*b* and the third leg 110*c*, respectively. That is, the two types of windings wound around the first leg 110*a*, the second leg 110*b* and the third leg 110*c*, respectively, may be wound in an overlapping manner around the core 110 in the winding order.

Herein, the winding of the two types of windings in an overlapping manner around the core 110 means that the two types of windings are wound overlappingly on a plane perpendicular to an axis of any one of the first leg 110*a*, the second leg 110*b* and the third leg 110*c* as shown in FIGS. 4 to 6. In other words, it has been shown in FIG. 2 that the first winding 210, the second winding 220 and the third winding 230 of the secondary coil 200 are wound at different positions on the first leg 110*a*, the second leg 110*b* and the third leg 110*c* in order to describe a winding method. However, the hybrid transformer 10 according to one embodiment of the present invention is actually constructed such that the first winding 210, the second winding 220 and the third winding 230 of the secondary coil 200 are wound in an overlapping manner around the respective legs 110*a*, 110*b*, and 110*c* in the winding order as shown in FIGS. 4 to 6.

In this case, two types of windings selected from the group consisting of the first winding 2100, the second winding 220 and the third winding 230 of the secondary coil 200 can be wound alternately around each of the first leg 110*a*, the second leg 110*b* and the third leg 110*c*. A winding, which is first wound around each of the first leg 110*a*, the second leg 110*b* and the third leg 110*c*, can be wound around each leg while abutting against each leg. In addition, the two types of windings wound alternately around each of the first leg, the second leg and the third leg are wound such that there is an increase in a separation distance between the windings and each leg 110*a*, 110*b* or 110*c* around which the two types of windings are wound in the winding order.

More specifically, the first winding 210, the second winding 220, the first winding 210, the second winding 220 and the first winding 210 are sequentially wound in an overlapping manner around the first leg 110*a*. In this case, the wound windings are wound so as to be insulated from each other. That is, the first winding 210, the second winding 220, the first winding 210, the second winding 220 and the first winding 210 sequentially wound around the first leg 110*a* are formed in such a fashion as to be spaced apart from each other at predetermined intervals such that they are insulated from each other. In this case, a first winding 110*a* of the primary coil 120 can be wound around the first winding 210 positioned at the outermost shell of first leg. At this time, the first winding 110*a* of the primary coil 120 is positioned so as to be spaced apart from the first winding 210 of the secondary coil 200 positioned at the outermost shell of the first leg. In the meantime, it has been shown in FIGS. 4 and 5 that the first winding 210 of the secondary coil 200 positioned at the outmost shell of the first leg 110*a* is connected to the neutral wire N. But, the present invention is not limited thereto, and if the first winding 210 of the secondary coil 200 is connected to the neutral wire N, the position of a relevant first winding 210 is not important.

The second winding 220, the third winding 230, the second winding 220, the third winding 230 and the second winding 220 are sequentially wound in an overlapping manner around the second leg 110*b*. In this case, the wound windings are wound so as to be insulated from each other. That is, the second winding 220, the third winding 230, the second winding 220, the third winding 230 and the second winding 220 sequentially wound around the second leg 110*b* are formed in such a fashion as to be spaced apart from each other at predetermined intervals such that they are insulated from each other. In this case, a second winding 120*b* of the primary coil 120 can be wound around the second winding 220 positioned at the outermost shell of the second leg. At this time, the second winding 120*b* of the primary coil 120 is positioned so as to be spaced apart from the second winding 220 of the secondary coil 200 positioned at the outermost shell of the second leg. In the meantime, it has been shown in FIGS. 4 and 5 that the second winding 220 of the secondary coil 200 positioned at the outmost shell of the second leg 110*b* is connected to the neutral wire N. But, the present invention is not limited thereto, and if the second winding 220 of the secondary coil 200 is connected to the neutral wire N, the position of a relevant second winding 220 is not important.

The third winding 230, the first winding 210, the third winding 230, the first winding 210 and the third winding 230 are sequentially wound in an overlapping manner around the third leg 110*c*. In this case, the wound windings are wound so as to be insulated from each other. That is, the third winding 230, the first winding 210, the third winding 230, the first winding 210 and the third winding 230 sequentially wound around the third leg 110*c* are formed in such a fashion as to be spaced apart from each other at predetermined intervals such that they are insulated from each other. In this case, a third winding 120*c* of the primary coil 120 can be wound around the third winding 230 positioned at the outermost shell of the third leg. At this time, the third winding 120*c* of the primary coil 120 is positioned so as to be spaced apart from the third winding 230 of the secondary coil 200 positioned at the outermost shell of the third leg. In the meantime, it has been shown in FIGS. 4 and 5 that the third winding 230 of the secondary coil 200 positioned at the outmost shell of the third leg 110*c* is connected to the neutral wire N. But, the present invention is not limited thereto, and if the third winding 230 of the secondary coil 200 is connected to the neutral wire N, the position of a relevant third winding 230 is not important.

In the meantime, the hybrid transformer 10 according to one embodiment of the present invention may be a transformer manufactured in an insulation manner selected from the group consisting of a dry type, a mold type, an oil-filled type and a gas type, but is not limited thereto. More specifically, the dry type transformer is a transformer that is used without being immersed in insulation oil and is insulated by exposing a main body of the transformer to the atmosphere instead of the insulation oil and cooling it. The mold type transformer is a transformer that is molded with epoxy resin as a fire retardant. The oil-filled type transformer is a transformer that uses insulation oil as an insulation medium. In addition, the gas type transformer is a transformer that uses gas such as SF6 as an insulation medium. That is, the hybrid transformer 10 according to one embodiment of the present invention 10 may adopt any insulation type if the overlappingly wound windings can be formed so as to be insulated and spaced apart from each other in the winding order. It is of course to be noted that the present invention can include various insulation manners other than the above-mentioned insulation manners within a range which can be implemented by a person of ordinary skill in the art to which the present invention pertains.

In the meantime, the first winding 210 of the secondary coil 200 is wound in a zig-zag fashion around the first leg 110*a* and the third leg 110*c* in the order of the first leg 110*a*, the third leg 110*c*, the first leg 110*a*, the third leg 110*c* and the first leg 110*a*. In this case, the wound windings that are insulated from each other and spaced apart from each other are connected by a first connecting wire 211 in order to implement the hybrid transformer 10 in which the windings are wound in an overlapping manner as shown in FIGS. 4 to 6.

In other words, the first winding 210 is separately wound around the first leg 110*a* and the third leg 110*c*, respectively, and the first windings 210 divided into a plurality of sections are connected to each other by the first connecting wire 211 so as to interconnect the first windings 210 wound around the first leg 110*a* and the third leg 110*c*.

Similarly, the second winding 220 is separately wound around the first leg 110*a* and the second leg 110*b*, respectively, and the second windings 220 divided into a plurality of sections are connected to each other by a second connecting wire 221 so as to interconnect the second windings 220 wound around the first leg 110*a* and the second leg 110*b*.

The third winding 230 is separately wound around the second leg 110*b* and the third leg 110*c*, respectively, and the third windings 230 divided into a plurality of sections are connected to each other by a third connecting wire 231 so as to interconnect the third windings 230 wound around the second leg 110*b* and the third leg 110*c*.

In FIG. 5, the first connecting wire 211, the second connecting wire 221 and the third connecting wire 231 are indicated by lines with different thicknesses for the sake of distinction, but is not limited thereto. That is, the first connecting wire 211, the second connecting wire 221 and the third connecting wire 231 may be the same as each other or different from each other in terms of their thickness. Alternatively, the first connecting wire 211, the second connecting wire 221 and the third connecting wire 231 may be configured with the same lines as those of the first winding 210, the second winding 220 and the third winding 230.

Referring to FIG. 6, it can be seen that the first winding 120*a*, the second winding 120*b* and the third winding 120*c* of the primary coil 120 wound around the outermost shells of the first leg 110*a*, the second leg 110*b* and the third leg 110*c*, respectively, are connected to each other in a delta (Δ) pattern by connecting wire 121.

According to the hybrid transformer according to one embodiment of the present invention, a plurality of windings are wound in an overlapping manner around each of the first leg 110*a*, the second leg 110*b* and the third leg 110*c*.

In general, when a plurality of windings is wound around one leg in the transformer, they are wound at different positions of the leg, respectively. More specifically, the plurality of windings is wound juxtaposedly in an axial direction of the leg. For example, windings are wound around three legs according to the pattern of the conceptual view of FIG. 2 or 6. In such a construction, since a separation distance is required to be secured between the plurality of windings wound juxtaposedly around the leg, a necessary space and volume is significantly increased. In addition, a winding method is complicated in which the windings are wound in a zig-zag fashion, and the transformer is difficult to manufacture, which contributes to an increase in the manufacturing cost. In the meantime, there is involved a problem in that the volume of the transformer increases and the winding method is complicated, leading to an increase in leakage current.

According to the hybrid transformer according to one embodiment of the present invention, a plurality of windings is wound overlappingly on a plane perpendicular to an axis direction of each of the first leg 110*a*, the second leg 110*b* and the third leg 110*c*. That is, since the plurality of windings is wound overlappingly around an axis of each of the legs 110*a*, 110*b* and 110*c*, the demanded length of each of the leg 110*a*, 110*b* and 110*c* is remarkably shortened. Thus, the volume of the transformer can be greatly reduced.

In addition, according to the hybrid transformer according to one embodiment of the present invention, the zig-zag winding method is easily performed. More specifically, referring to FIGS. 4 to 6, since the first winding 210, the second winding 220 and the third winding 230 wound overlappingly around the first leg 110*a*, the second leg 110*b* and the third leg 110*c* are connected to each other by the first connecting wire 211, the second connecting wire 221 and the third connecting wire 231, the winding method becomes significantly simple. Thus, the time and cost in the manufacture process can be greatly saved, resulting in an increase in a manufacturing cost saving effect.

Moreover, according to the hybrid transformer according to one embodiment of the present invention, since the windings are wound efficiently at less volume, the efficiency of the transformer increases. That is, since the transformer is implemented in a more efficient structure and method, it is possible to provide a hybrid transformer which is considerably excellent in both a harmonics reduction function and a current unbalance cancellation function while maintaining a transformer performance.

A hybrid transformer according to another embodiment of the present invention will be described hereinafter with reference to FIGS. 7 to 10.

Figure 7:
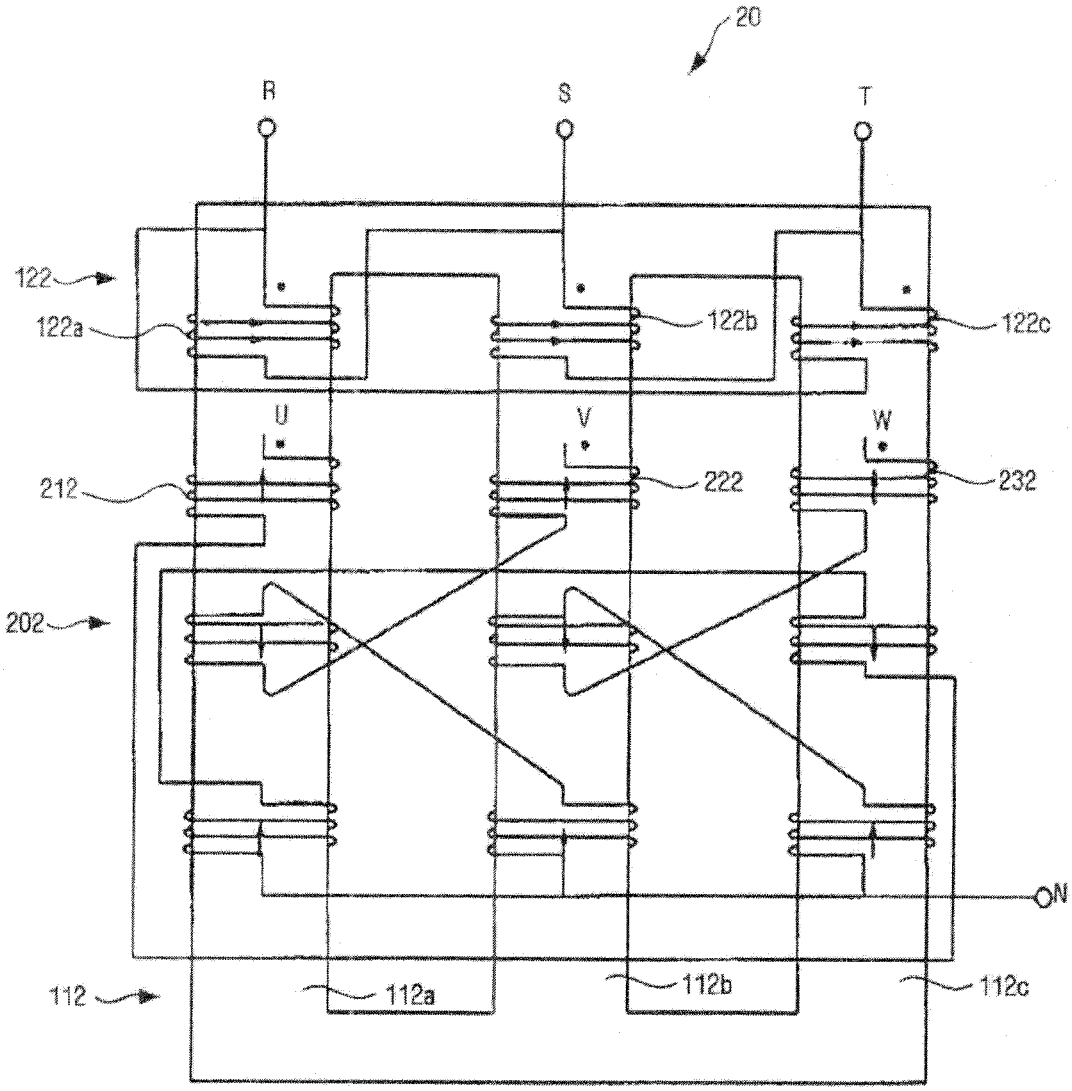
FIG. 7 is a conceptual view illustrating a hybrid transformer according to another embodiment of the present invention.
Figure 8:
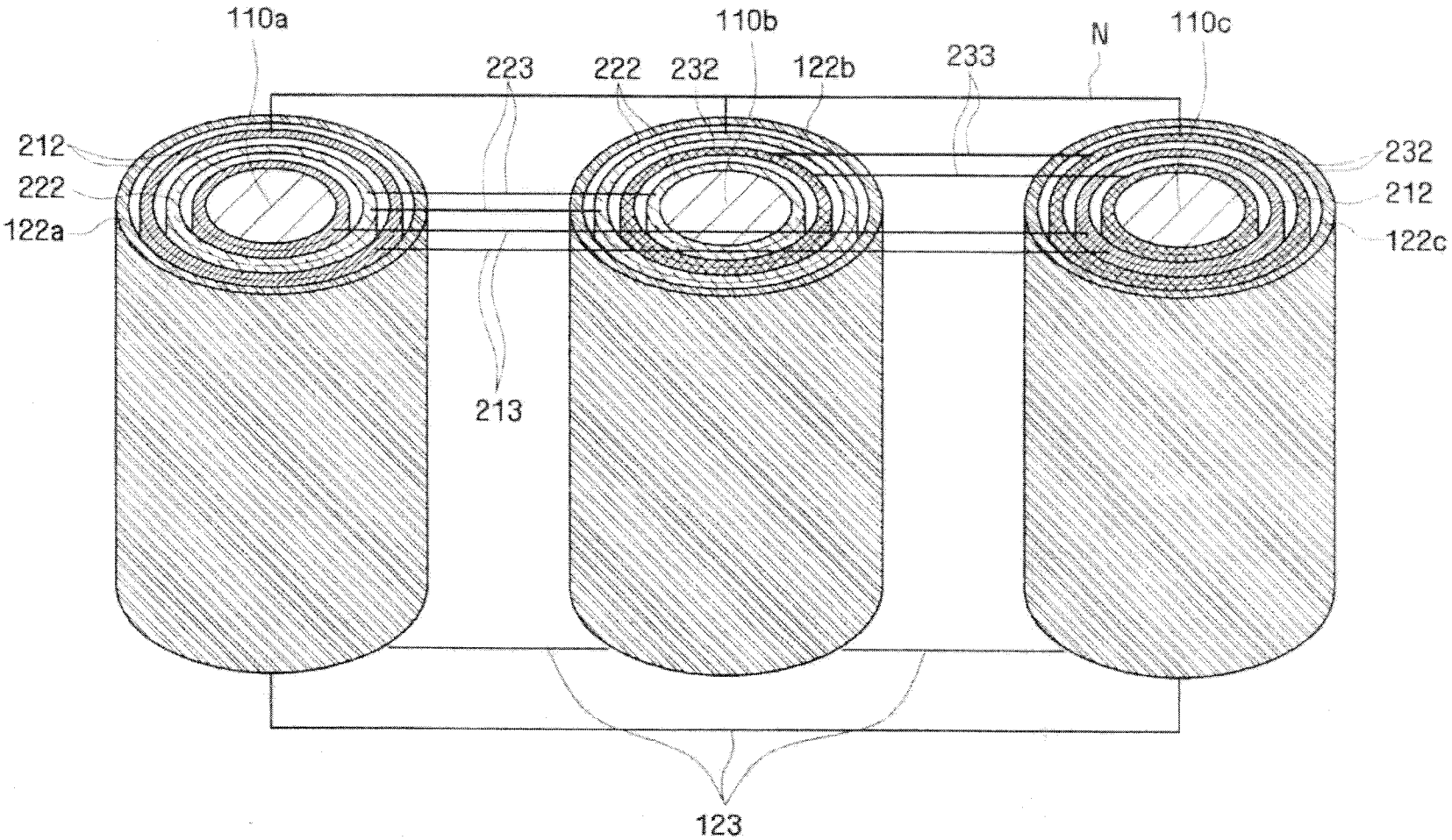
FIG. 8 is a perspective view illustrating a hybrid transformer according to another embodiment of the present invention.
Figure 9:
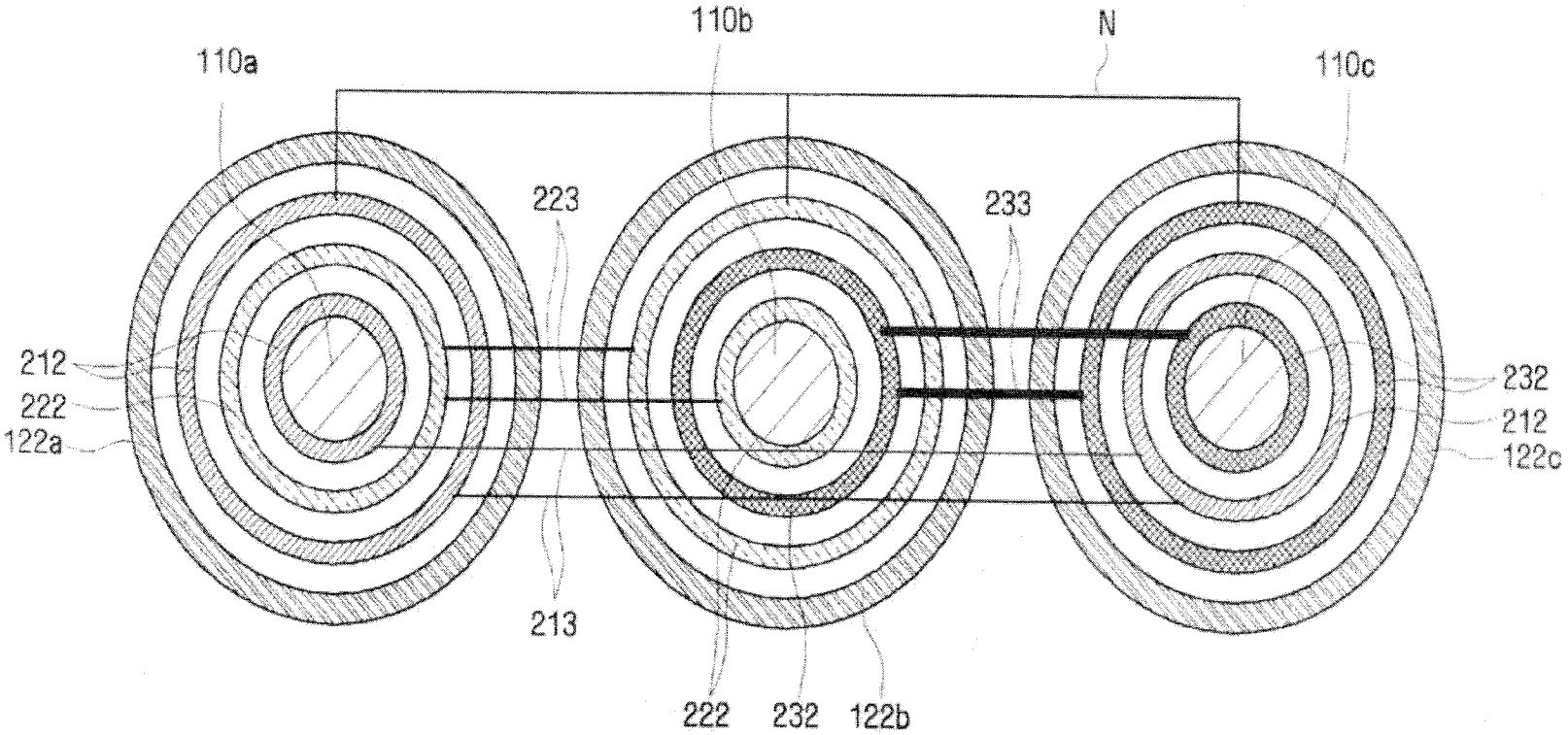
FIG. 9 is a top plan view of the hybrid transformer shown in FIG. 8.
Figure 10:
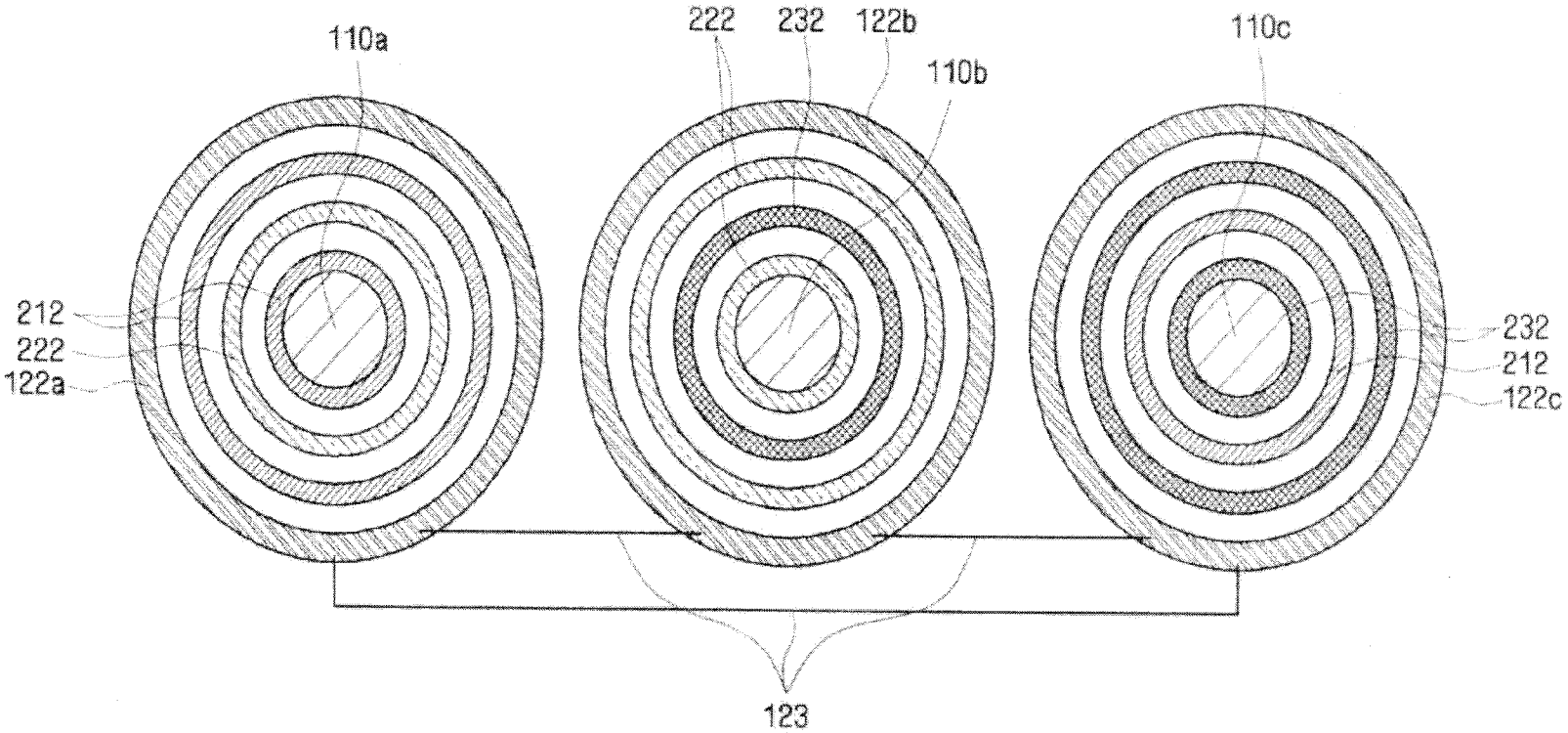
FIG. 10 is a bottom view of the hybrid, transformer shown in FIG. 8.

FIG. 7 is a conceptual view illustrating a hybrid transformer according to another embodiment of the present invention, FIG. 8 is a perspective view illustrating a hybrid transformer according to another embodiment of the present invention, FIG. 9 is a top plan view of the hybrid transformer shown in FIG. 8, and FIG. 10 is a bottom view of the hybrid transformer shown in FIG. 8.

Referring to FIGS. 7 to 10, the hybrid transformer according to another embodiment of the present invention is different from the hybrid transformer according to one embodiment of the present invention in terms of the number of zig-zag windings. In the hybrid transformer according to another embodiment of the present invention, a detailed description of the same contents as those of the hybrid transformer according to one embodiment of the present invention will be omitted to avoid redundancy.

In the hybrid transformer 20 according to another embodiment of the present invention, a first winding 212 of a secondary coil 202 is wound in a zig-zag fashion around the first leg 112*a* and the third leg 112*b* in the order of the first leg 112*a*, the third leg 112*b* and the first leg 112. A second winding 222 of the secondary coil 202 is wound in a zig-zag fashion around the second leg 112*b* and the first leg 112*a* in the order of the second leg 112*b*, the first leg 112*a* and the second leg 112*b*. Also, a third winding 232 of the secondary coil 202 is wound in a zig-zag fashion around the third leg 112*c* and the second leg 112*b* in the order of the third leg 112*c*, the second leg 112*b* and the third leg 112*c*. In this case, the windings wound sequentially around each of the legs 112*a*, 112*b* and 112*c* are wound in an overlapping manner so as to be insulated from each other and spaced apart from each other is the same as in the hybrid transformer according to one embodiment of the present invention.

Meanwhile, the first winding 212, the second winding 222 and the third winding 232 separately formed on different legs 112*a*, 112*b* and 112*c* are connected to each other by a first connecting wire 213, a second connecting wire 223 and the third connecting wire 233.

The first winding 122*a*, the second winding 122*b* and the third winding 122*c* of the primary coil 122 are overlappingly wound around the first winding 212, the second winding 222 and the third winding 232 wound around the outermost shell of each of the first leg 112*a*, the second leg 112*b* and the third leg 112*c*. The first winding 122*a*, the second winding 122*b* and the third winding 122*c* of the primary coil 122 are wound in the A pattern by a connecting wire 123.

While the embodiments of the present invention have been described in connection with the exemplary embodiments illustrated in the drawings, they are merely illustrative embodiments and the invention is not limited to these embodiments. It is to be understood that various other equivalent modifications and variations of the embodiments can be made by a person of ordinary skill in the art without departing from the spirit and scope of the present invention.

That is, the embodiments of the present invention described herein are merely illustrative, and both the hybrid transformer and the power supply system which can be derived with the overall purport of the specification may be included in the scope of the present invention. It is natural that other than the hybrid transformer and the power supply system of the illustratively described structure, a transformer and system of the type in which the main features of the present invent can be implemented is included in the scope of the present invention. Therefore, both the hybrid transformer and the power supply system, which include a structure in which the windings are wound overlappingly on a plane perpendicular to an axis of each of the legs constituting the core, i.e., a structure in which a plurality of windings is wound overlappingly around the core, can be all included in the scope of the present invention. In the zig-zag transformers, a transformer including a structure in which a plurality of windings is wound in an overlapping manner around the legs may be included in the scope of the present invention irrespective of the order, method and number of zig-zag windings. In addition, a transformer including a structure in which a plurality of windings is wound in an overlapping manner around the core may be included in the scope of the present invention irrespective of an insulation method, a construction material, a winding method.

INDUSTRIAL APPLICABILITY

The hybrid transformer having a transformation function and an improved function of harmonics and current unbalance, and the power supply system including the same according to the embodiments of the present invention can be applied to all the systems and structures of a technical field needing transformers. In addition, the present invention can be applied to the transformer as well as a technical filed in which harmonics reduction and current unbalance improvement is required.

The invention claimed is:

1. A hybrid transformer comprising a primary coil, a secondary coil and a core, wherein the core comprises a first leg, a second leg and a third leg, and the secondary coil comprises a first winding, a second winding and a third winding, which are wound in a zig-zag fashion around the first leg, the second leg and the third leg, respectively, so as to be connected to a neutral wire, and wherein two types of windings selected from the group consisting of the first winding, the second winding and the third winding of the secondary coil are wound alternately around the first leg, the second leg and the third leg, respectively, in such a fashion as to be wound in an overlapping manner around the core in the winding order.

2. The hybrid transformer according to claim 1, wherein the two types of windings wound alternately around each of the first leg, the second leg and the third leg are wound such that there is an increase in a separation distance between the windings and each leg around which the two types of windings are wound in the winding order.

3. The hybrid transformer according to claim 2, wherein a winding, which is first wound around each of the first leg, the second leg and the third leg, can be wound around each leg while abutting against each leg.

4. The hybrid transformer according to claim 1, wherein the two types of windings wound alternately around each of the first leg, the second leg and the third leg are wound overlappingly on a plane perpendicular to an axis of each leg in the winding order.

5. The hybrid transformer according to claim 1, wherein the first winding, the second winding, the first winding, the second winding and the first winding are sequentially wound in an overlapping manner around the first leg, the second winding, the third winding, the second winding, the third winding and the second winding are sequentially wound in an overlapping manner around the second leg, and the third winding, the first winding, the third winding, the first winding and the third winding are sequentially wound in an overlapping manner around the third leg.

6. The hybrid transformer according to claim 1, wherein the first winding is wound around the first leg and the third leg in the order of the first leg, the third leg, the first leg, the third leg and the first leg, the second winding is wound around the second leg and the first leg in the order of the second leg, the first leg, the second leg, the first leg and the second leg, and the third winding is wound around the third leg and the second leg in the order of the third leg, the second leg, the third leg, the second leg and the third leg.

7. The hybrid transformer according to claim 1, wherein the primary coil is wound in an overlapping manner around the secondary coil wound around the outermost shell of each of the first leg, the second leg and the third leg.

8. The hybrid transformer according to claim 1, wherein the hybrid transformer is manufactured in an insulation manner selected from the group consisting of a dry type, a mold type, an oil-filled type and a gas type.

9. A hybrid transformer comprising a core including a first leg, a second leg and a third leg, and a first winding, a second winding and a third winding, which are wound in a zig-zag fashion around the first leg, the second leg and the third leg, wherein a plurality of windings selected from the group consisting of the first winding, the second winding and the third winding are wound around the first leg, the second leg and the third leg, respectively, in such a fashion as to be wound in an overlapping manner around the core in the winding order.

10. The hybrid transformer according to claim 9, wherein the plurality of windings wound around each of the first leg, the second leg and the third leg are wound such that there is an increase in a separation distance between the windings and each leg around which the plurality of windings are wound in the winding order.

11. The hybrid transformer according to claim 9, wherein the plurality of windings wound around each of the first leg, the second leg and the third leg are constructed such that two types of windings selected from the group consisting of the first winding, the second winding and the third winding are wound alternately around the first leg, the second leg and the third leg, respectively.

12. The hybrid transformer according to claim 9, wherein the first winding, the second winding and the third winding constitute a secondary coil of the transformer, and the hybrid transformer further comprises a primary coil wound in an overlapping manner around the secondary coil wound around each of the first leg, the second leg and the third leg.

13. A hybrid transformer comprising a primary coil, a secondary coil and a core, wherein the core comprises a first leg, a second leg and a third leg, and the secondary coil comprises a first winding, a second winding and a third winding, and wherein the first winding is wound around the first leg and the third leg in the order of the first leg, the third leg, the first leg, the third leg and the first leg so as to be connected to a neutral wire, the second winding is wound around the second leg and the first leg in the order of the second leg, the first leg, the second leg, the first leg and the second leg so as to be connected to the neutral wire, and the third winding is wound around the third leg and the second leg in the order of the third leg, the second leg, the third leg, the second leg and the third leg so as to be connected to the neutral wire, whereby the first winding, the second winding, the first winding, the second winding and the first winding are sequentially wound in an overlapping manner around the first leg, the second winding, the third winding, the second winding, the third winding and the second winding are sequentially wound in an overlapping manner around the second leg, and the third winding, the first winding, the third winding, the first winding and the third winding are sequentially wound in an overlapping manner around the third leg.

14. The hybrid transformer according to claim 13, wherein a plurality of windings wound in an overlapping manner around each of the legs is wound overlappingly on a plane perpendicular to an axis of each leg, and is wound such that there is an increase in a separation distance between the windings and each leg around which the windings are wound in the winding order.

15. The hybrid transformer according to claim 13, wherein a primary coil is wound in an overlapping manner around each of the first winding wound around the outermost shell of the first leg, the second winding wound around the outermost shell of the second leg, and the third winding wound around the outermost shell of the third leg.

16. A power supply system comprising the hybrid transformer according to claim 13.

17. A power supply system comprising the hybrid transformer according to claim 9.

18. A power supply system comprising the hybrid transformer according to claim 1.

* * * * *